US006665964B2

(12) United States Patent
Klotz

(10) Patent No.: US 6,665,964 B2
(45) Date of Patent: Dec. 23, 2003

(54) ARTIFICIAL AQUARIUM HAVING MAGNETIC AND WATER PUMP DRIVE SYSTEM

(76) Inventor: Kimberly March Klotz, 15670 Linda Ave., Los Gatos, CA (US) 95032

( * ) Notice: Subject to any disclaimer, the term of this patent is extended or adjusted under 35 U.S.C. 154(b) by 123 days.

(21) Appl. No.: 10/090,225

(22) Filed: Mar. 4, 2002

(65) Prior Publication Data

US 2003/0163937 A1 Sep. 4, 2003

(51) Int. Cl.[7] ..... G09F 19/00
(52) U.S. Cl. ..... 40/426; 40/406
(58) Field of Search ..... 40/426, 406, 409; 446/133, 134, 136, 129, 267

(56) References Cited

U.S. PATENT DOCUMENTS

| | | | | |
|---|---|---|---|---|
| 4,578,044 A | 3/1986 | Saitoh | 446/134 |
| 4,691,459 A | 9/1987 | Butler | 40/406 |
| 5,301,444 A | 4/1994 | Horiuchi | 40/426 |
| 5,463,826 A | 11/1995 | Horiuchi | 40/426 |
| 5,685,096 A | 11/1997 | Horiuchi | 40/426 |
| 6,148,770 A | 11/2000 | Lin | 119/253 |

*Primary Examiner*—Cassandra H. Davis
(74) *Attorney, Agent, or Firm*—Thomas Schneck; Nissa M. Strottman

(57) ABSTRACT

An apparatus and method for our artificial aquarium featuring artificial creatures, such as fish, behaving in a life-like manner. A tank is equipped with electromagnets which create magnetic fields which act on magnets within the artificial fishes' bodies, causing them to move. The tank's electromagnets are activated by a programmable logic controller (PLC). Input devices placed in the tank may send signals to the PLC, causing the activation or deactivation of certain electromagnets which affects the movements of the fish. Water flow from a water pump may also cause the artificial fishes to move.

61 Claims, 11 Drawing Sheets

ARTIFICIAL AQUARIUM HAVING MAGNETIC AND WATER PUMP DRIVE SYSTEM

FIELD OF THE INVENTION

This invention relates to artificial aquaria, especially those with artificial aquatic creatures.

BACKGROUND OF THE INVENTION

Aquaria are popular fixtures in homes and offices as well as other public venues, such as hotels and restaurants. In addition to providing an impressive display of fish and other marine life such as invertebrates, coral, and/or plants, aquaria are also valued for their soothing effect on observers.

Although the benefits of an aquarium are great, large amounts of time and money are required to set up and maintain an aquarium. In addition to buying the equipment necessary to set up an aquarium (at minimum, a tank, gravel or sand, filters, heaters, and animals), cleaning, feeding, and restocking an aquarium require time and money as well as a certain level of expertise to ensure that the water quality (salinity, pH, nitrite levels, temperature, etc.) is acceptable, the tank's inhabitants are receiving the correct diet, and the tank's occupants can peacefully coexist. "Catastrophic" events, such as disease, tank leaks, or power failures which disable filters and heaters, can kill off all tank inhabitants; these events are not uncommon and may occur regardless of the aquarist's experience and precautions to ensure these events do not happen.

There are also environmental concerns associated with keeping aquariums, particularly saltwater tanks. In addition to the threat posed by pollution, coral reefs are also endangered because both the coral and reef life are "harvested" to provide material for aquariums. Many species of fish and other marine life which cannot exist in captivity (generally because of issues related to the animal's food supply) are captured and sold to unsuspecting aquarists. Furthermore, most marine species do not breed in captivity, so the demand for marine creatures that are caught in their natural habitat is likely to continue unabated.

In addition, "biological pollution" from escaped aquaria organisms poses an even greater potential hazard. For example, an algae believed to have been introduced into coastal waters by disposal of tank water into a municipal water disposal threatens to overwhelm and displace native algae in the Mediterranean and California, perhaps irreversibly altering these ecosystems.

Some reefs are now being designated as "no-take" ecological reserves, meaning that the removal of any marine organism from a protected reef is prohibited. While protection for reefs is welcome from an environmental point of view, it is likely that the cost of fish, coral, and other marine organisms taken from unprotected reefs will increase as a result of this protection. Consequently, the cost of keeping a marine aquarium will also increase.

Given these problems, an artificial aquarium is an attractive proposition to those who wish to enjoy the benefits of an aquarium without the drawbacks of aquarium ownership and maintenance. The prior art contains several examples of artificial aquaria.

U.S. Pat. No. 4,578,044 discloses a toy aquarium containing a toy fish having an interior magnet and a base with a permanent magnet. A magnetic coil in the base generates magnetic force; a change in the polarity of lines of this magnetic force causes the permanent magnet to move. The movement of the permanent magnet is transmitted to the toy fish by means tethering the toy fish to the base.

U.S. Pat. No. 4,691,459 discloses an artificial aquarium with a whirlpool pump which causes circular movement of the water in the aquarium tank. This circular movement causes weighted toy fish in the aquarium to move. A baffle prevents the toy fish from being sucked into the whirlpool pump.

U.S. Pat. Nos. 5,301,444; 5,463,826, and 5,685,096 are artificial aquaria containing artificial fish with magnets. Rotating magnets generate magnetic fields at different speeds, causing the fish to move around.

U.S. Pat. No. 6,148,770 discloses an artificial aquarium with ornamental features (artificial jellyfish, for instance) which move in response to a changing magnetic field created by magnets in the base. The ornamental features have magnets and are weighted or otherwise secured so they do not float to the top.

None of the prior art discussed here discloses an artificial aquarium where the artificial fish display realistic behavior (eating, fighting, etc.). It is an object of this invention to provide a mechanism that enables artificial fish to simulate realistic behavior.

None of the prior art discussed here discloses an artificial aquarium that employs both waterflow and magnetic fields to make artificial fish move.

SUMMARY OF THE INVENTION

An artificial aquarium is stocked with artificial aquatic creatures, such as fish, as well as artificial rocks and corals to provide a realistic simulation of a fish tank with live creatures. Each of the artificial creatures has a slight negative buoyancy when submerged in water. Additionally, the creatures each have magnets encased within their bodies.

There are two mechanisms which cause the creatures to move around the tank: water flow and magnetic fields. One or more water pumps circulate water in the tank, creating a "current" which causes the artificial creatures to move around the tank as if they were swimming. In addition to the water pump, a number of electromagnets are placed around the tank, some in a central column in the tank, others within artificial rocks and coral. A programmable logic controller controls the activation of the electromagnets. The fields generated by these electromagnets attract and repulse the artificial creatures. The artificial creatures move in a life-like manner due to the movement created by the combination of the magnetic fields and the water flow within the tank.

Realistic behavior, such as feeding and hiding, can also be simulated. As noted above, the activation of the electromagnets is controlled by a programmable logic controller. Inputs to the logic controller, such as optical sensors placed around the tank, can cause the controller to either activate or deactivate the electromagnets placed around the tank. For instance, if an optical sensor placed near one of the artificial corals detects an artificial creature passing by, it can signal the programmable logic controller which in turn activates the electromagnet within the artificial coral. The activated electromagnet attracts the magnet embedded within the creature. As a result of this attraction, the creature appears to be feeding on the coral. The logic controller can deactivate the magnet after a certain period of time, causing the creature to move away from the coral as it drifts with the flow.

DETAILED DESCRIPTION OF THE INVENTION

Figure 1:
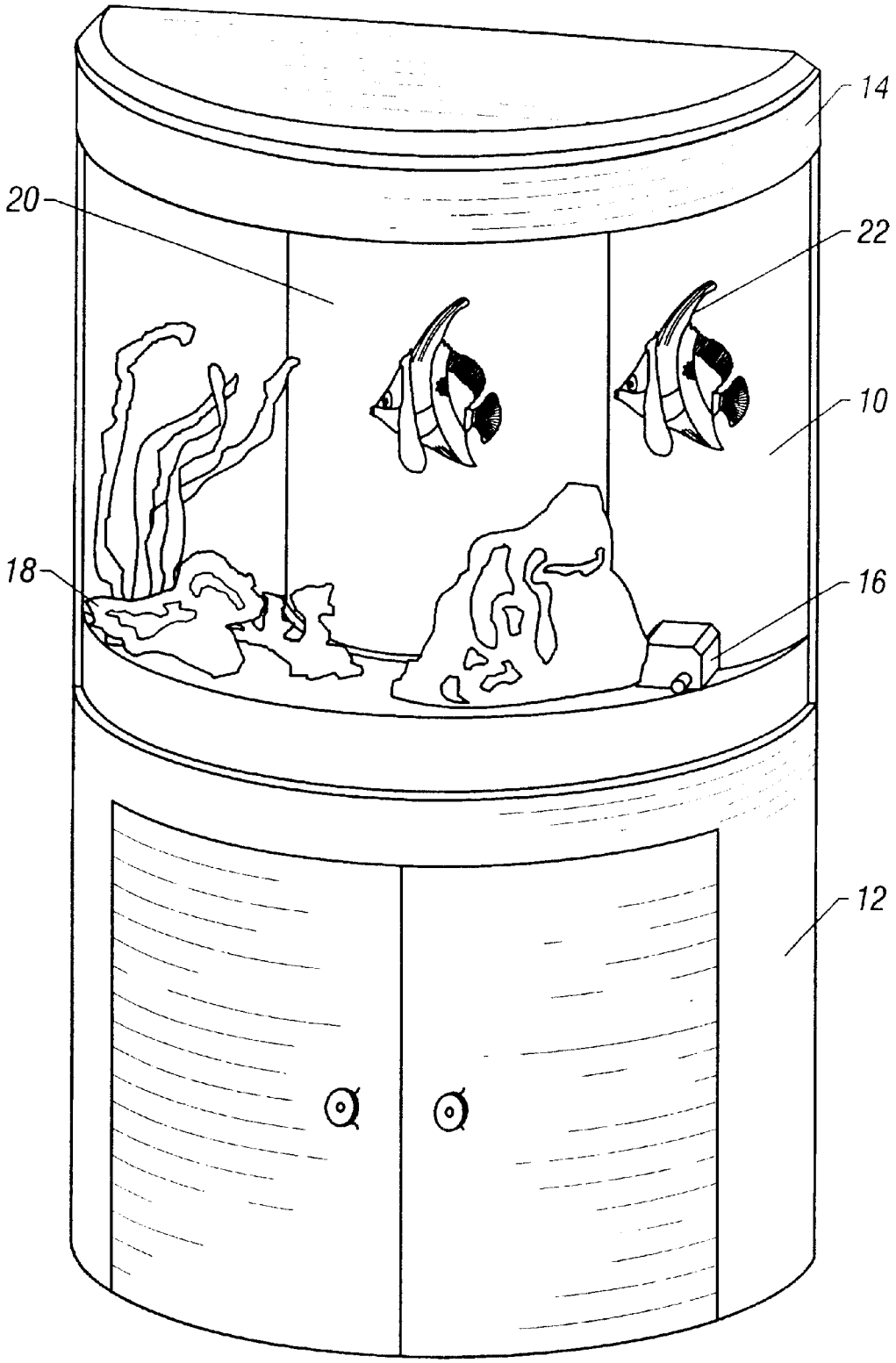
FIG. 1 is a view of an artificial aquarium in accordance with the invention.
Figure 5:
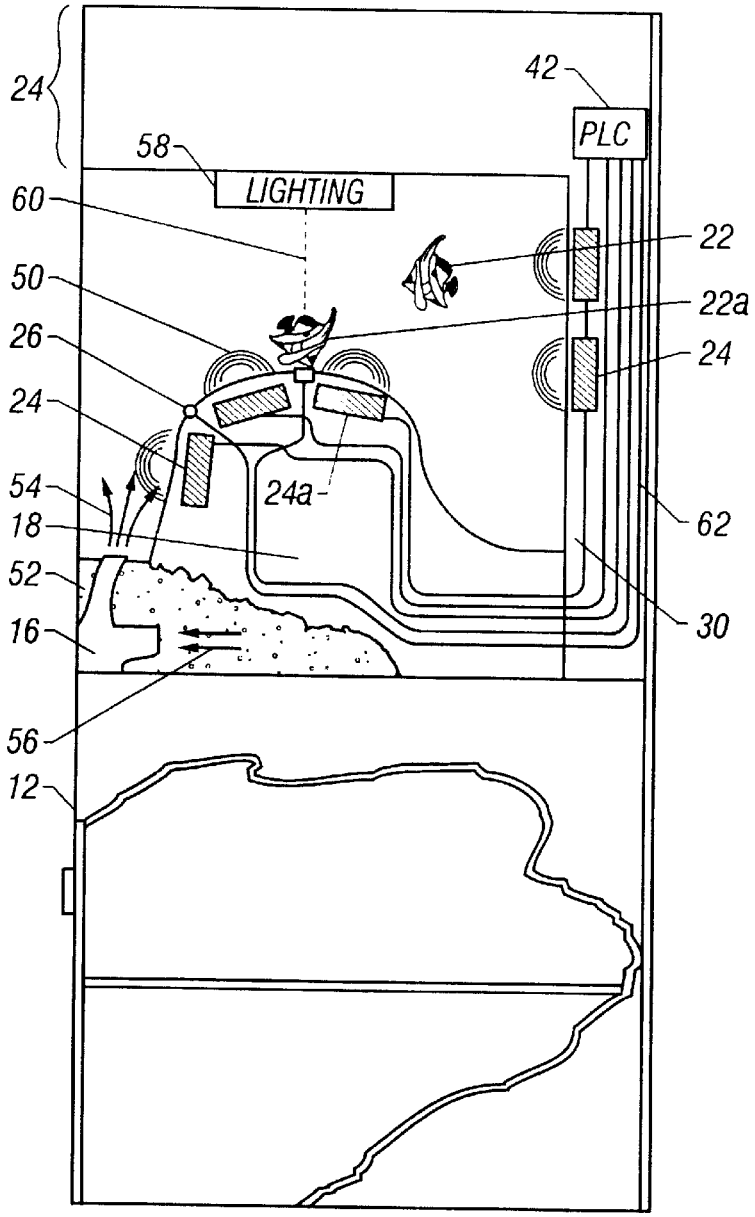
FIG. 5 is a cut-away view of the artificial aquarium shown in FIG. 1.

With respect to FIG. 1, the artificial aquarium of the invention includes a fish tank 10 with a top assembly, or lid 14. The tank 10 can rest on a stand 12 (as shown in FIG. 5, the stand can also be used for storage). The tank is equipped with a water pump 16, decorative objects 18, including artificial rocks, coral, or plants, artificial aquatic creatures 22, including fish, and a waterproof casing 20 covering a central column located toward the back of the tank. In this embodiment, the tank 10 has a half-cylindrical front to promote laminar flow of water within the tank 10; this assists the fish 22 to move freely throughout the tank 10 and not become trapped in one area of the tank 10. The tank 10 may have a different shape in other embodiments.

Figure 2:
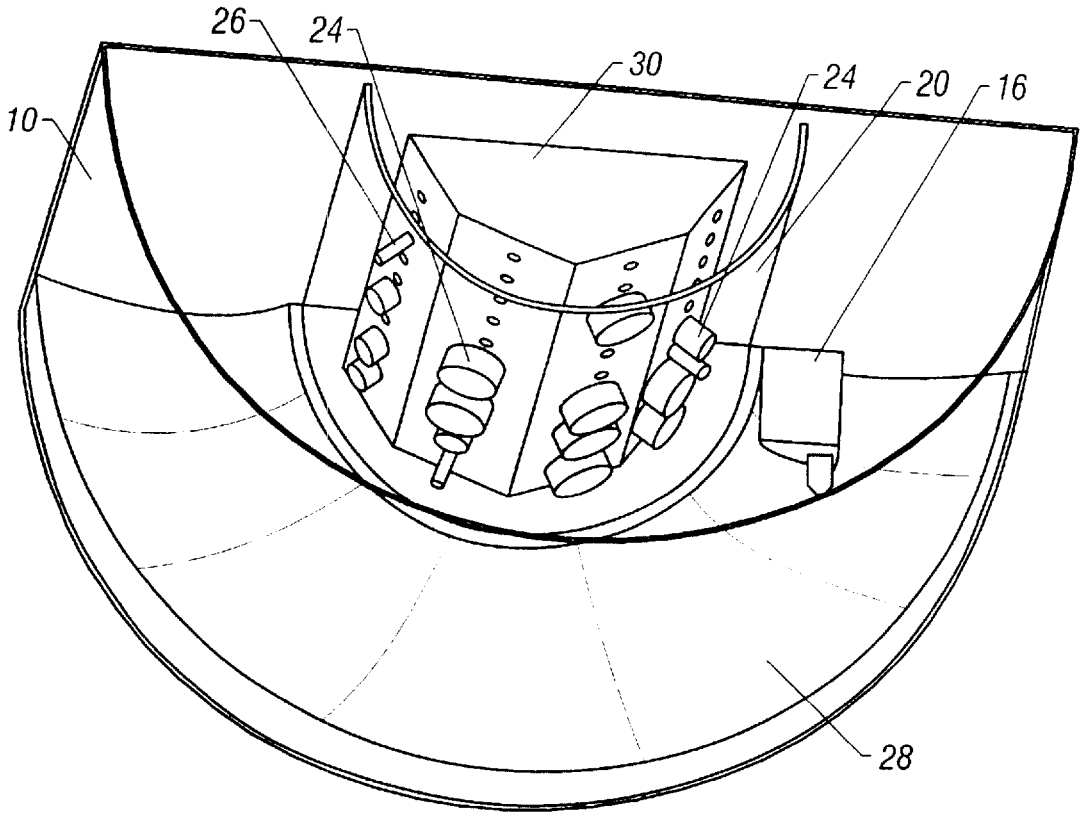
FIG. 2 is an overhead view of the tank and some components used in the artificial aquarium shown in FIG. 1.

In FIG. 2, the tank 10 is shown in greater detail. The central column casing 20 is a decorative, waterproof shield which protects a central column 30 containing electromagnets 24 and optical sensors 26 (the operations of the electromagnets 24 and sensors 26 will be discussed in greater detail below in FIG. 5; the central column 30 may contain variously-sized and strategically-placed electromagnets 24). The bottom 28 of the tank is concave to promote water flow (see FIG. 11). Although the water pump 16 shown here is attached to the bottom 28 of the tank 10, in other embodiments the water pump may be located anywhere in the tank 10. The water pump 16 may be exposed or hidden from view (i.e., underneath gravel).

Figure 3:
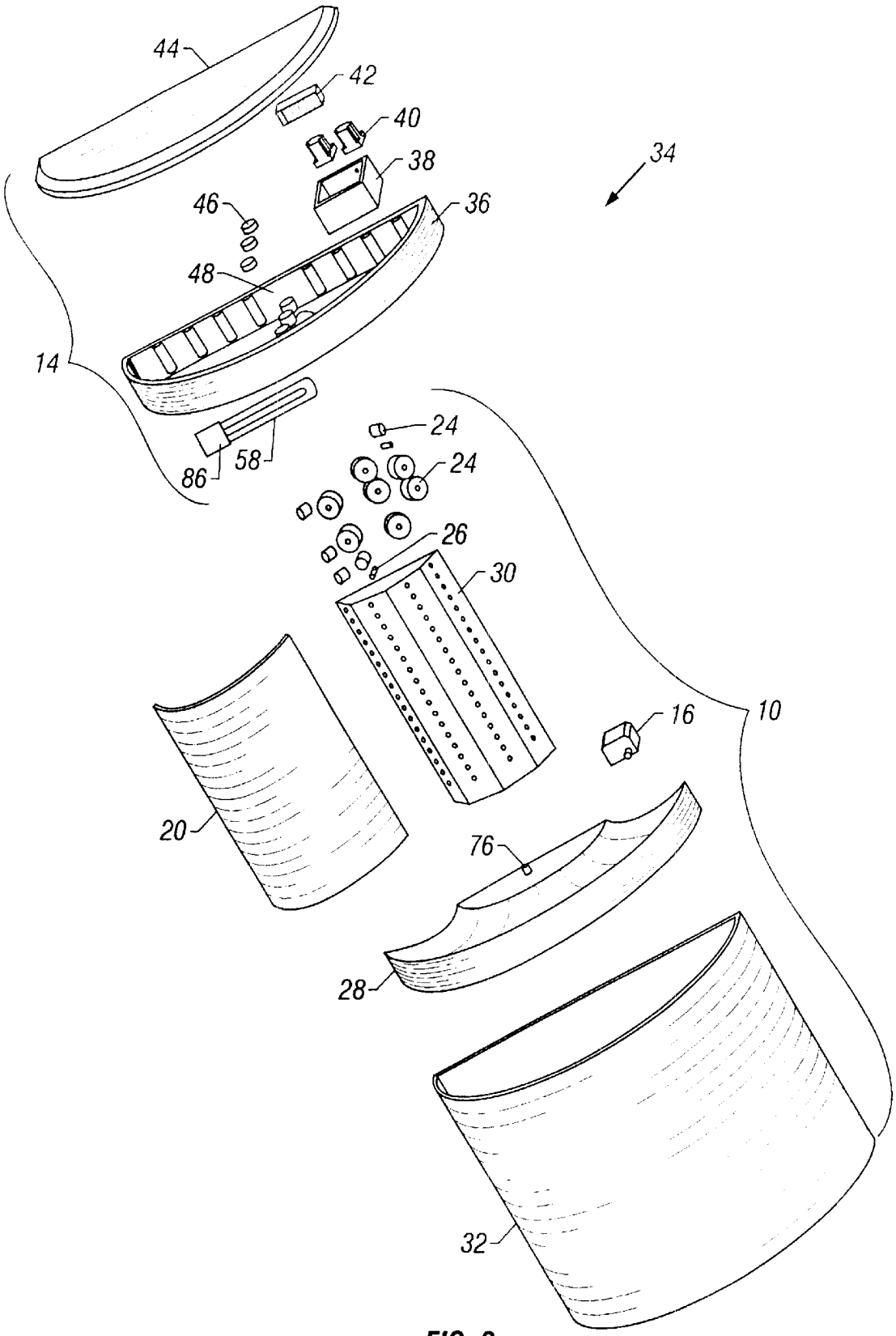
FIG. 3 is an exploded view of the tank and components of the artificial aquarium shown in FIG. 1.

An exploded view of the tank assembly 34 is shown in FIG. 3. The tank 10 portion of the assembly 34 includes: the glass or acrylic walls 32; the bottom of the tank 28; the water pump 16; the central column 30; the central column casing 20; assorted electromagnets 24 to be attached to the central column 30; and assorted sensors 26, also to be attached to the central column 30. The lid, or top assembly, 14 includes the following: a bottom casing 36 for the lid assembly; a lighting system, in this embodiment a socket 86 and lightbulb 58, which is affixed to the bottom casing 36; a programmable logic controller/power supply casing 38; two power supplies 40; a programmable logic controller (PLC) 42; feed-thrus 48 for passing electrical wires between the central column 30 and the lid 14; cap feed-thrus 46 for guiding the wires; and a top casing 44 of the lid 14. The top assembly 14 is watertight. The electronics assembly, the PLC 42, power supplies 40, and associated wiring, etc. may be stored somewhere else (for example, the bottom of the tank 10 or in storage beneath the tank 10) in another embodiment.

Figure 4:
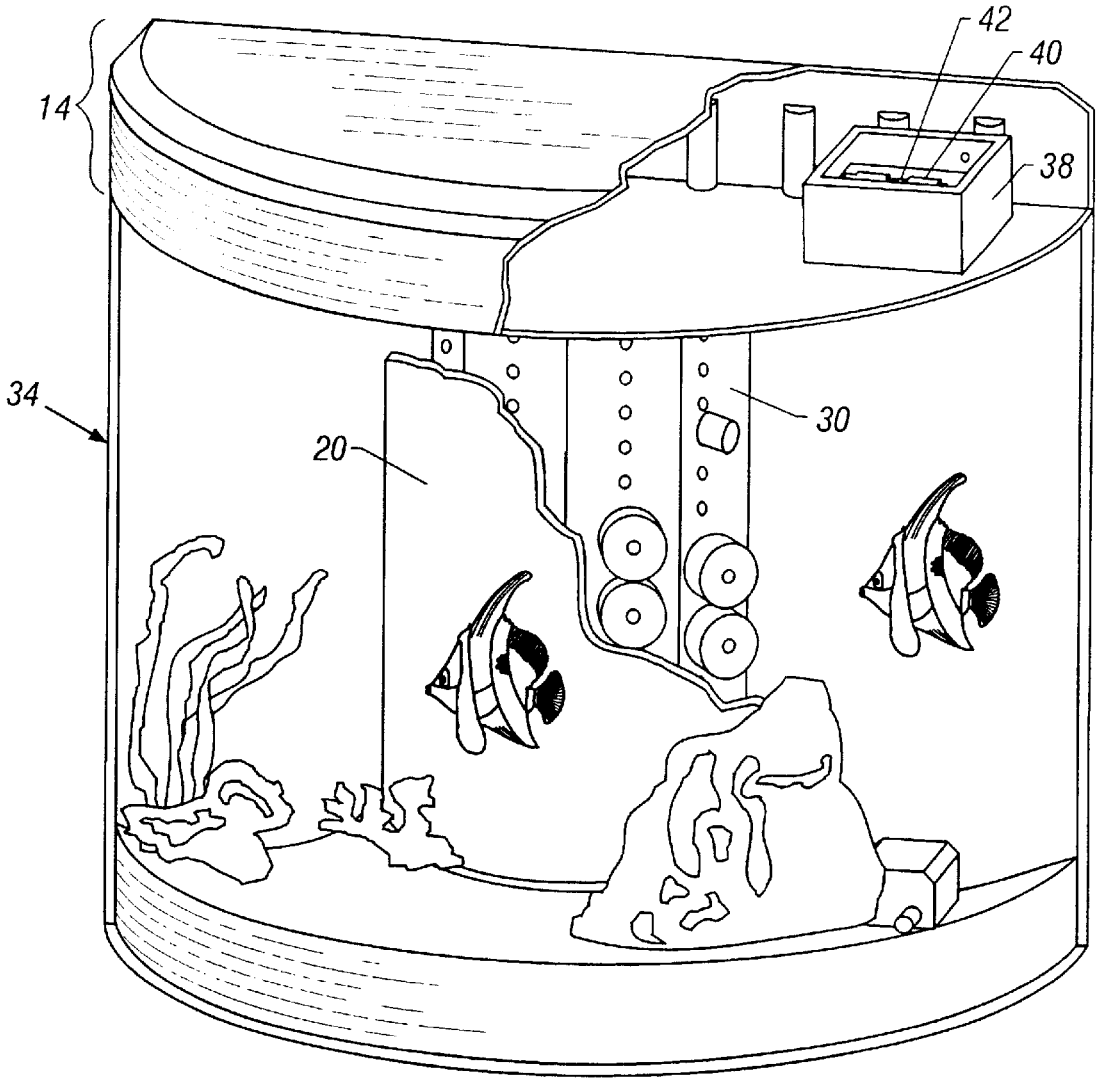
FIG. 4 is a partial cut-away view of the artificial aquarium shown in FIG. 1.

With respect to FIG. 4, the assembled tank assembly 34 is shown. The cutaway portion of the figure shows the central column casing 20, the central column 30, and the top lid assembly 14 with the power supplies 40 and programmable logic controller 42 within their casing 38.

As shown in FIG. 5, the tank is decorated with artificial rocks or coral 18. The corals 18 contain electromagnets 24, controlled by the programmable logic controller 42, and may also contain input devices such as optical sensors 26, which transmit information to the PLC 42. The artificial corals 18 are covered in a waterproof casing. (As noted above in FIG. 2, optical sensors 26 may also be contained in the central column 30.) Information or commands sent by or to the PLC 42 by the electromagnets 24 or the sensors 26 is relayed by wires 62. Activated electromagnets 24 in the coral 18 and central column 30 generate magnetic fields 50. The water pump 16, which along with the corals 18 may be surrounded by gravel, sand, or artificial crushed coral 52 covering the bottom of the tank, continually takes in water 56, thus recycling the water in the tank and creating a water flow 54. The magnetic fields 50, combined with the water flow 54 generated by the water pump 16 combine to act on the fish 22 (described in greater detail below in FIGS. 6*a* and 6*b*) in the tank, with the result that they move about the tank in a lifelike manner.

Figure 6A:
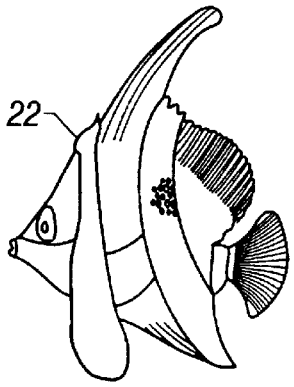
FIG. 6*a* is a view of an artificial fish used in the artificial aquarium shown in FIG. 1.
Figure 6B:
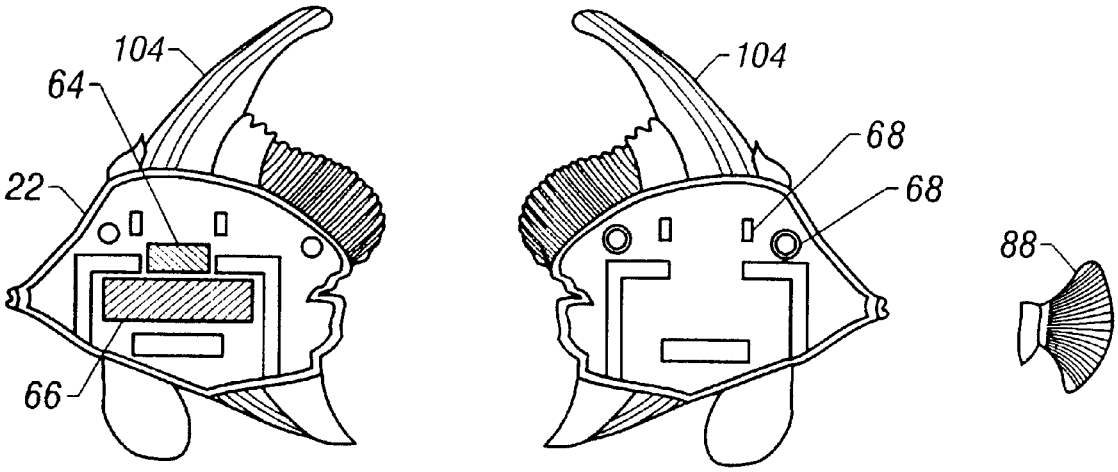
FIG. 6*b* is a sectional view of the artificial fish shown in FIG. 6*a*.

An example of the artificial fish 22 used in the aquarium is illustrated in FIGS. 6*a* and 6*b*. An intact fish 22 is shown in FIG. 6*a*. The fish 22 are modeled on real marine or fresh water fish and constructed of plastic, fiberglass, or similar material. In this embodiment, the fish may have silicone skins to enhance their life-like appearance and reduce or eliminate any sound which might occur if a fish 22 swims into a tank wall. As shown in FIG. 6*b*, the fish 22 contains an earth magnet 64 and sufficient ballast 66 to ensure the fish has slightly negative buoyancy when submerged in water. The fish 22 in this embodiment is covered in a silicone skin 104. The two halves of the fish 22 are fastened together by pins 68. A tail piece 88 is also attached. In other embodiments, the magnets 64, ballast 66, and pins 68 may be located in different positions and the tail piece 88 may not be detached from the body.

Referring again to FIG. 5, the water flow 54 causes the fish 22 to move about the tank. The magnetic fields 50 generated by the electromagnets 24 also effect movement in the fish 22. The fish 22, which as noted above contain a magnet, are attracted or repelled by the magnetic fields 50. Electromagnets 24 may be used to induce simulated behavior in the fish 22. For example, feeding behavior, such as nibbling on corals, can be simulated by using the sensors 26 and electromagnets 24. As noted above, the aquarium contains a lighting system 58. Optical sensors 26 can be placed throughout the tank, in this case, on coral 18, to monitor light beams 60. If a fish 22A swims through a beam 60 and interrupts the light flow to the sensor 26, the sensor 26 can signal the PLC 42, which in turn can activate a nearby electromagnet 24A. The resulting magnetic field 50 attracts the nearby fish 22A to the coral 18. The PLC 42 can turn off the electromagnet 24A after a predetermined period of time, releasing the fish 22A. This entire sequence simulates a fish's 22A feeding behavior, i.e., nibbling on coral 18 for a period of time and then swimming away. Other behaviors, such as schooling together or hiding, can be simulated in similar fashion.

Figure 7:
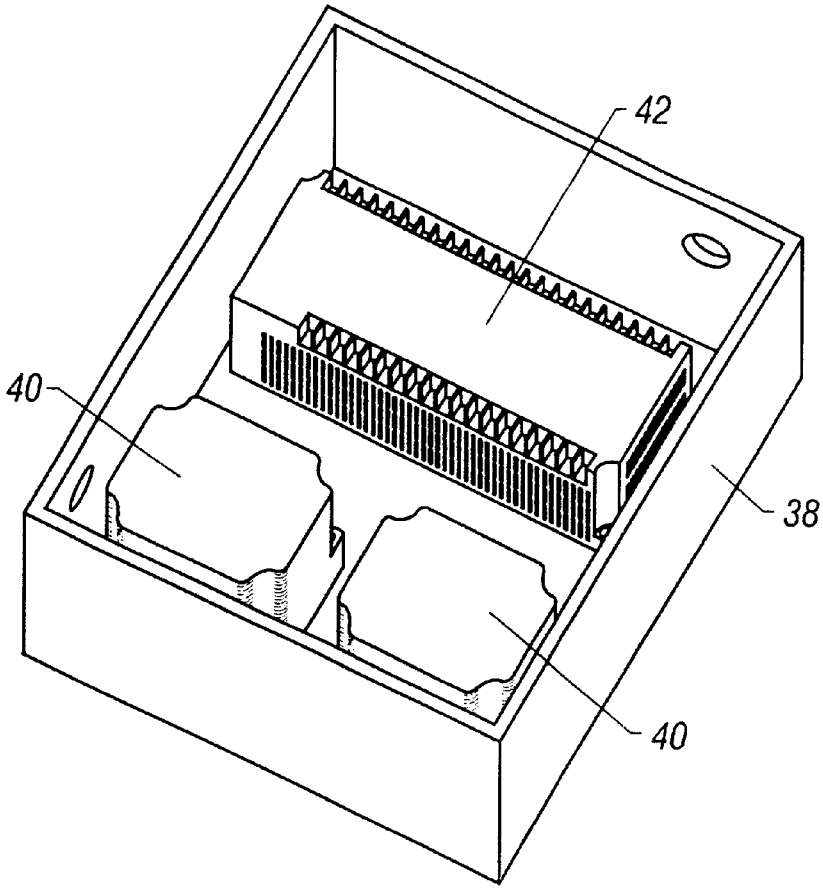
FIG. 7 is an overhead view of the power supplies and programmable logic controllers used in the artificial aquarium shown in FIG. 1.

The power supplies 40 and PLC 42 are shown in FIG. 7. In this embodiment, there are two power supplies 40 to run the aquarium's lighting, electromagnets, sensors, pumps, PLC 42, etc. The power supplies 40 are standard 12–24 volt supplies with built-in transformers. The PLC 42 is also standard and receives input from the sensors, as described above in FIG. 5, and sends commands to the electromagnets in the aquarium, also described in FIG. 5. The power supplies 40 and the PLC are shown within a casing 38 that is watertight. All of the electronic assembly complies with NEMA, UL, FCC, CE, and NEC requirements.

Figure 8:
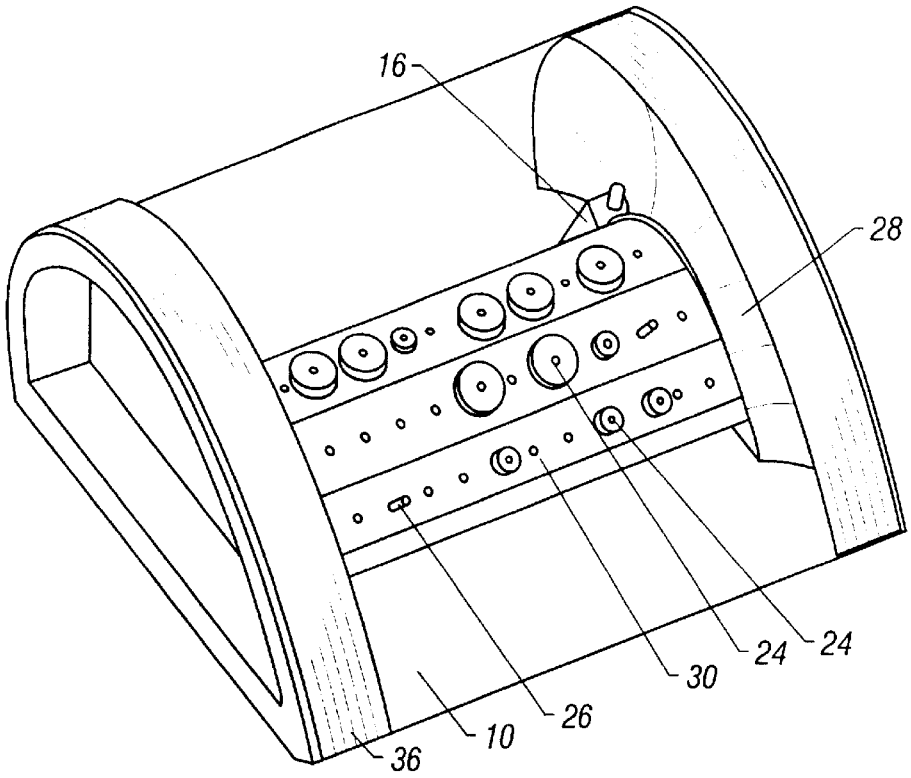
FIG. 8 is a side view of the tank and some components used in the artificial aquarium shown in FIG. 1.

Another view of the tank 10 and the central column 30 are presented in FIG. 8. The bottom of the lid assembly 36 is presented without the electronic assembly discussed above in FIG. 3. In this embodiment, the water pump 16 is attached to the bottom surface of the tank 28, but it may be placed elsewhere in the tank. The central column 30 contains a variety of electromagnets 24 as well as optical sensors 26; the electromagnets 24 and sensors 26 may be placed in different locations on the central column 30.

Figure 9:
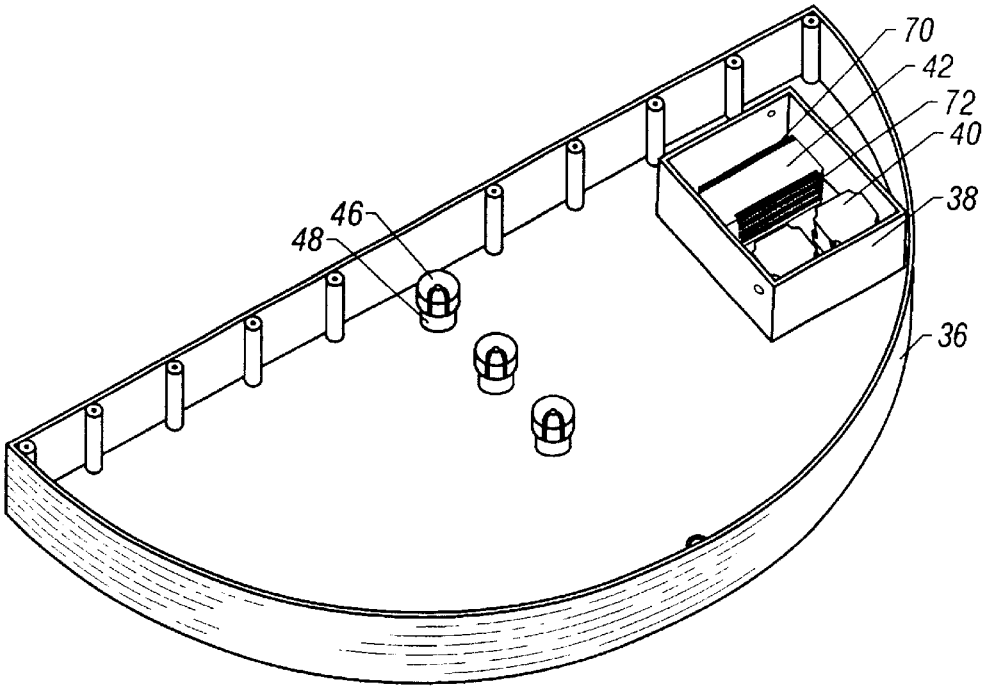
FIG. 9 is an exposed view of the top assembly of the artificial aquarium shown in FIG. 1.

With respect to FIG. 9, the bottom of the lid assembly 36 containing portions of the invention's electronics assembly is shown in detail. Wires (see FIG. 5) connecting the power supply 40 and PLC 42 with electromagnets, sensors, the water pump, etc. within the tank are passed through feed thrus 48. The feed thrus 48 have caps 46 for guiding the wires. As noted above, the power supplies 40 and PLC 70 are contained in a watertight enclosure 38. The PLC is configured to receive input 72 from sensors in the tank and send output 70 to devices such as the water pump and electromagnets.

Figure 10:
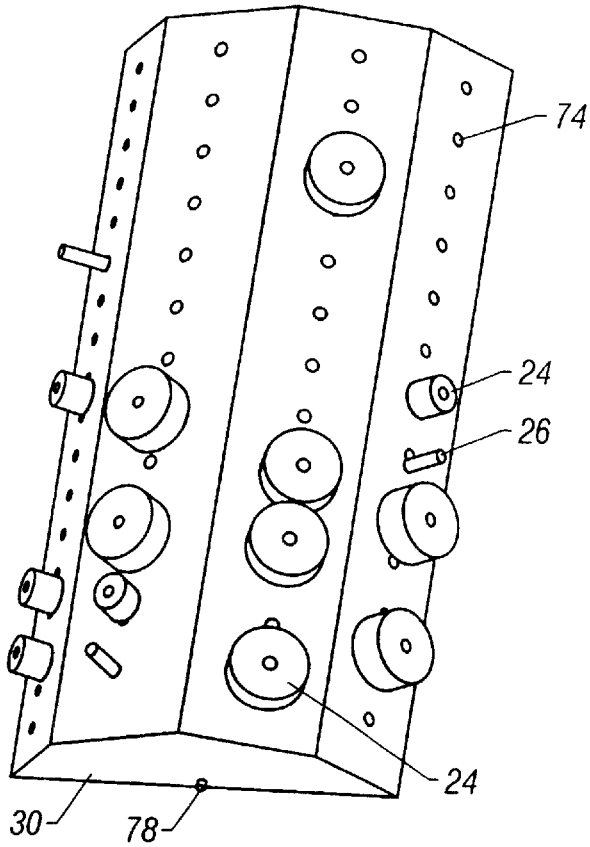
FIG. 10 is a view of the central column of the artificial aquarium shown in FIG. 1.

The central column 30 is detailed in FIG. 10. In this embodiment, the column 30 is semi-cylindrical, having a top, bottom, and five sides, four of which contain magnets 24 and sensors 26. The bottom of the column has a pin 78 to fasten it to the bottom surface of the tank. The four sides of the column 30 which contain magnets 24 and sensors 26 have holes 74 for mounting the magnets 24 and sensors 26. The holes 74 in the column 30 allow wires to pass from the magnets 24 and sensors 26 to the power supplies and PLC. The column may be shaped differently in other embodiments.

Figure 11:
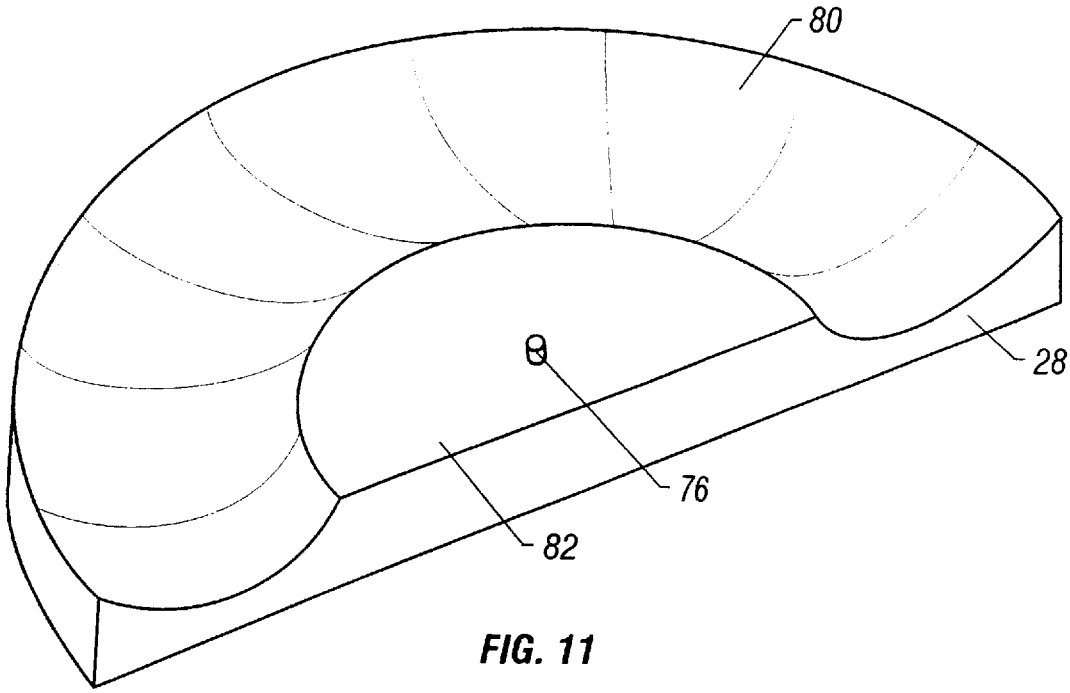
FIG. 11 is a view of the bottom assembly of the artificial aquarium shown in FIG. 1.

With respect to FIG. 11, the bottom surface of the tank 28 has a concave section 80 to improve water circulation. The bottom surface 28 also features a platform 82 for mounting the central column. The platform 82 has a fastening device 76 for holding the central column in place on the platform 82.

Figure 12A:
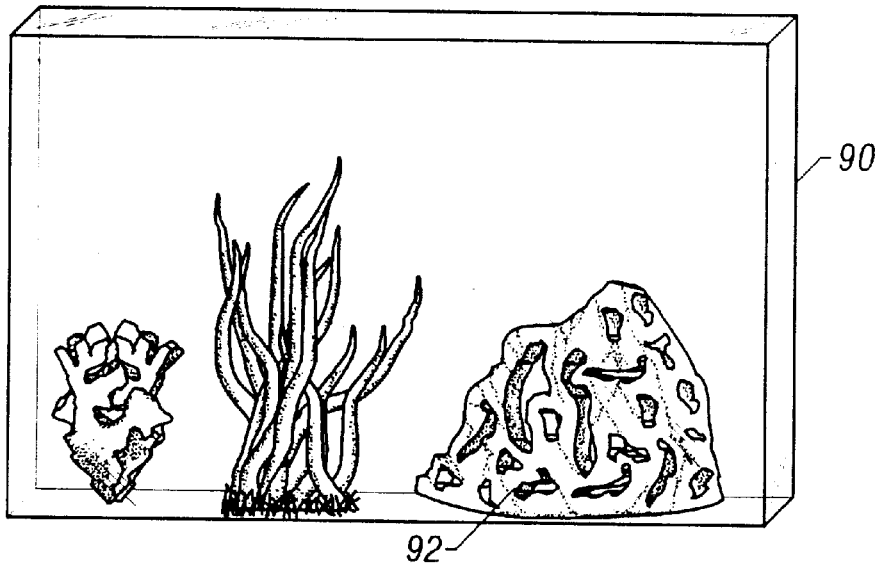
FIG. 12*a* is an isolated view of one example of the rear wall of the tank of the artificial aquarium showed in FIG. 1.
Figure 12B:
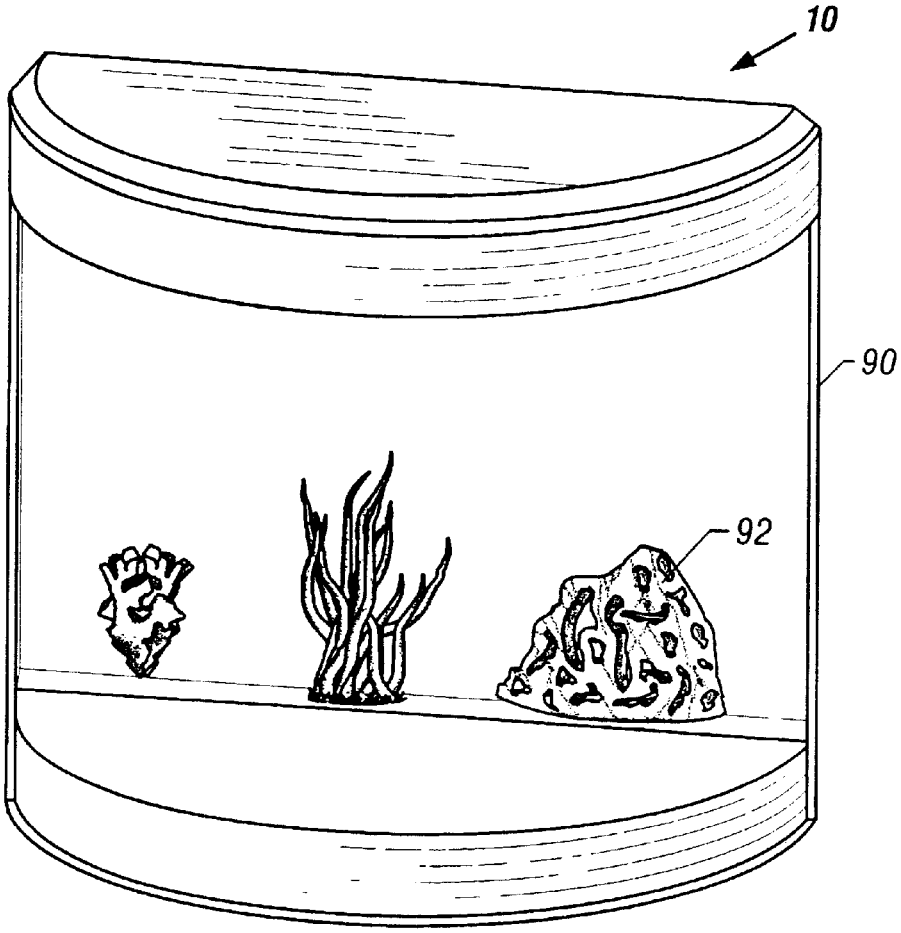
FIG. 12*b* is a view of the tank with the rear wall shown in FIG. 12*a*.

With reference to FIG. 12*a*, in some embodiments of the aquarium the back wall 90 of the tank can contain decoration 92 such as artificial coral, rock, or plants. As shown in FIG. 12*b*, the use of this special wall 90 adds a further decorative effect to the tank 10. The decoration 92 may be placed at various points in the wall 90 in different embodiments.

Figure 13A:
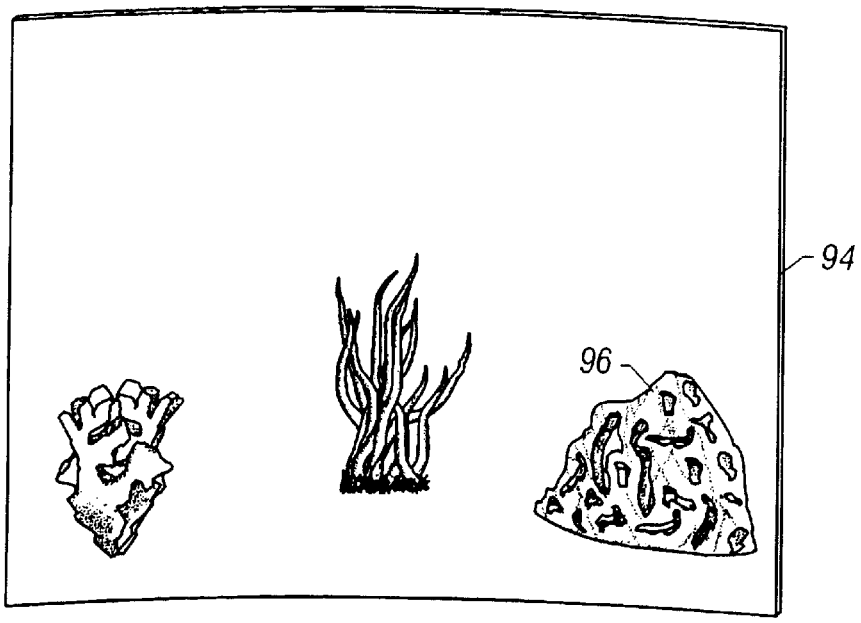
FIG. 13*a* is a view of a backdrop to be attached to the back of the tank of one embodiment of the artificial aquarium shown in FIG. 1.
Figure 13B:
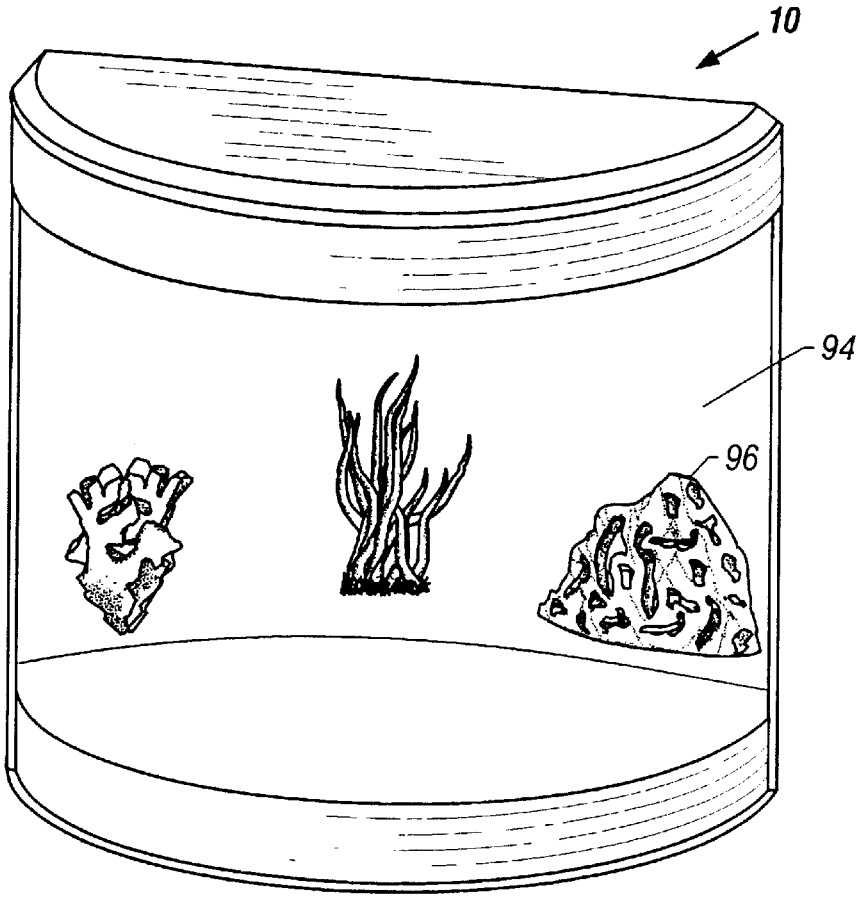
FIG. 13*b* is a view of the tank with the attached backdrop shown in FIG. 13*a*.

Some embodiments of the aquarium can also feature a backdrop 94 for the tank that also features decoration 96 such as artificial coral, rock, or plants, as shown in FIG. 13*a*. This backdrop can be bowed, and in some embodiments the bow in the backdrop will match the curvature of the front panel of the tank. As shown in FIG. 13*b*, the backdrop 94 with the decoration 96 attaches to the back of the tank 10. Because the backdrop 94 is bowed, it adds an extra element of depth to the tank 10.

Figure 13C:
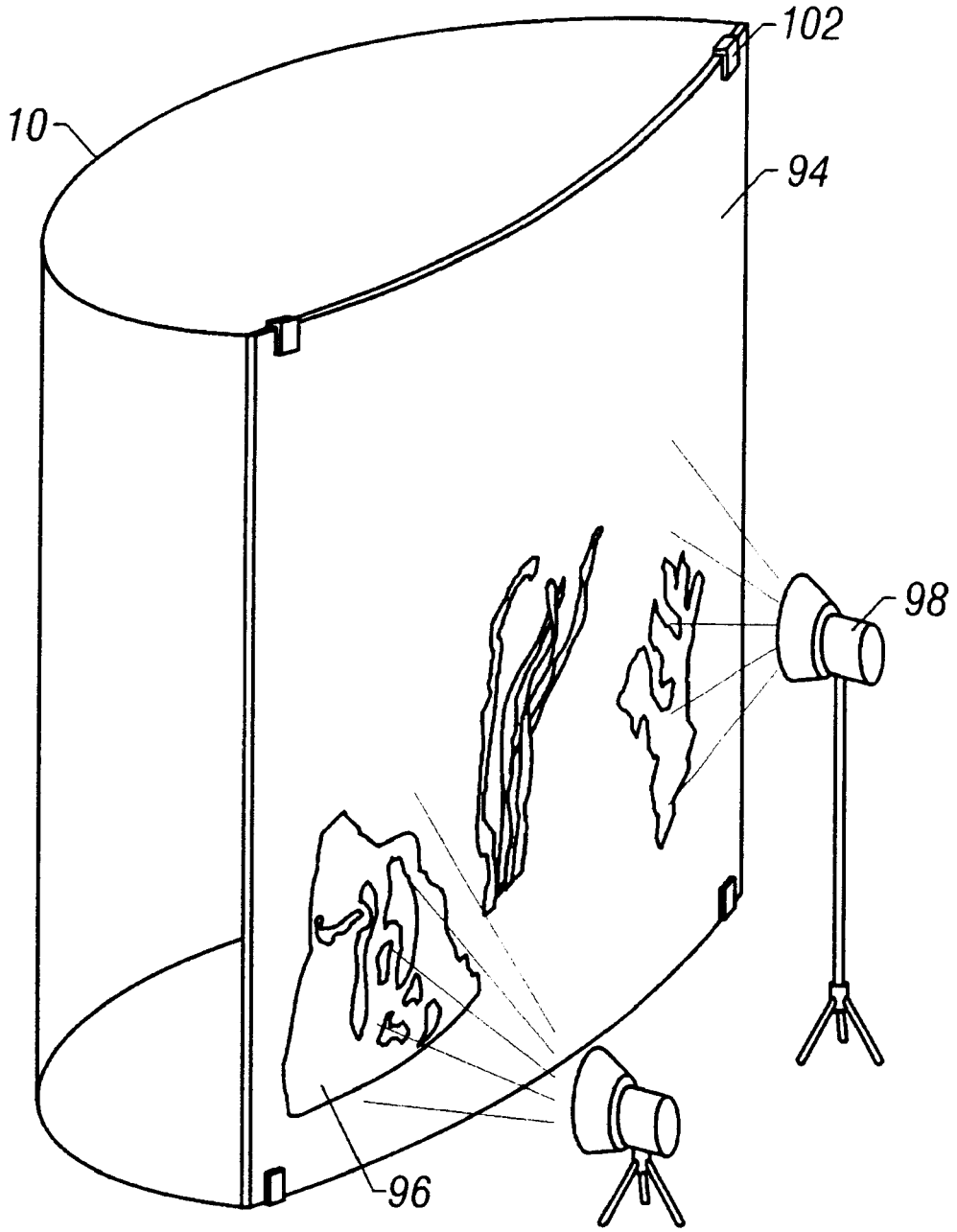
FIG. 13*c* is a side view of the tank with the attached backdrop shown in FIG. 13*a*.

As shown in FIG. 13*c*, the backdrop 94 may be attached to the back of the tank 10 by clips 102. A lighting system 98 may be employed behind the tank 10 to further illuminate the decoration 96 on the backdrop 94.

What is claimed is:

1. An artificial aquarium for use with at least one artificial aquatic creature having a magnet enclosed in a body, said aquarium comprising:

a) an aquarium tank, said tank to be filled with water;

b) a plurality of electromagnets placed in various locations inside the tank, at least one of the plurality of electromagnets encased in a waterproof decorative casing; and c) a programmable logic controller located outside the tank configured to control activation of the plurality of electromagnets, wherein the plurality of electromagnets generates a plurality of magnetic fields, said plurality of magnetic fields acting on the magnet in the at least one artificial aquatic creature, said plurality of magnetic fields causing the at least one creature to move within the tank.

2. The aquarium of claim 1 wherein the at least one artificial aquatic creature is a fish.

3. The aquarium of claim 1 wherein the waterproof decorative casing is selected from the group consisting of:

a) an artificial coral;

b) an artificial rock; and c) an artificial plant.

4. The aquarium of claim 1 further including at least one water pump, said at least one water pump producing a water flow which lifts and propels the at least one artificial aquatic creature.

5. The aquarium of claim 1 further including at least one input device configured to deliver an input signal to the programmable logic controller, said input device located within the tank.

6. The aquarium of claim 5 wherein the at least one input device is an optical sensor.

7. The aquarium of claim 5 wherein the at least one input device is attached to the waterproof decorative casing.

8. The aquarium of claim 1 further including a lighting system.

9. The aquarium of claim 4 wherein the at least one water pump has a graduated flow rate.

10. The aquarium of claim 1 further including a column located inside the tank, said column contained inside a waterproof casing.

11. The aquarium of claim 10 wherein some of the plurality of electromagnets are located on the column.

12. The aquarium of claim 10 wherein at least one input device configured to deliver an input signal to the programmable logic controller is located on the column.

13. The aquarium of claim 1 further including an assembly fitting on top of the aquarium tank.

14. The aquarium of claim 13 wherein the programmable logic controller is contained within the assembly.

15. The aquarium of claim 13 wherein the lighting system is adjacent to the assembly.

16. The aquarium of claim 1 wherein the tank has a half-cylindrical front face to promote laminar flow of water within the tank.

17. The artificial aquarium of claim 1 wherein a wall of the tank contains decoration selected from the group consisting of:

a) an artificial coral;

b) an artificial rock; and c) an artificial plant.

18. The artificial aquarium of claim 1 further including a backdrop attached to a back surface of the tank, said backdrop having decoration selected from the group consisting of:

a) an artificial coral.

19. The artificial aquarium of claim 18 further including a second lighting system to illuminate the backdrop.

20. The artificial aquarium of claim 18 wherein the backdrop is bowed.

21. An artificial aquarium comprising:

a) an aquarium tank, said tank to be filled with water;

b) a plurality of artificial aquatic creatures, each of the plurality of creatures having a magnet encased in a body, each of the plurality of creatures having slightly negative buoyancy when submerged in water inside the aquarium tank;

c) at least one water pump within the tank, said at least one water pump producing a water flow which lifts and propels each of the plurality of creatures;

d) a plurality of electromagnets placed in various locations inside the tank, at least one of the plurality of electromagnets encased in a waterproof decorative casing; and e) a programmable logic controller located outside the tank configured to control activation of the plurality of electromagnets, wherein the plurality of electromagnets generates a plurality of magnetic fields, said plurality of magnetic fields acting on the magnets contained within the creatures, said plurality of magnetic fields and the water flow causing the creatures to move within the tank.

22. The aquarium of claim 21 wherein at least one of the plurality of creatures is a fish.

23. The aquarium of claim 21 wherein the waterproof decorative casing is selected from the group consisting of:

a) an artificial coral;

b) an artificial rock; and c) an artificial plant.

24. The aquarium of claim 21 further including at least one input device configured to deliver an input signal to the programmable logic controller, said input device located within the tank.

25. The aquarium of claim 24 wherein the at least one input device is an optical sensor.

26. The aquarium of claim 24 wherein the at least one input device is attached to of decorative casing.

27. The aquarium of claim 21 wherein the at least one water pump has a graduated flow rate.

28. The aquarium of claim 21 further including a column located inside the tank, said column contained inside a waterproof casing.

29. The aquarium of claim 28 wherein some of the plurality of electromagnets are located on the column.

30. The aquarium of claim 28 wherein at least one input device configured to deliver an input signal to the programmable logic controller is located on the column.

31. The aquarium of claim 21 further including a lighting system.

32. The aquarium of claim 21 further including an assembly fitting on top of the aquarium tank.

33. The aquarium of claim 32 wherein the programmable logic controller is contained within the assembly.

34. The aquarium of claim 32 wherein the lighting system is adjacent to the assembly.

35. The aquarium of claim 21 wherein the tank has a half-cylindrical front face to promote laminar flow of water within the tank.

36. The artificial aquarium of claim 21 wherein a wall of the tank contains decoration selected from the group consisting of:

a) an artificial coral;

b) an artificial rock; and c) an artificial plant.

37. The artificial aquarium of claim 21 further including a backdrop attached to a back surface of the tank, said backdrop having decoration selected from the group consisting of:

a) an artificial coral;

b) an artificial rock; and c) an artificial plant.

38. The artificial aquarium of claim 37 further including a second lighting system to illuminate the backdrop.

39. The artificial aquarium of claim 37 wherein the backdrop is bowed.

40. An artificial aquarium comprising:

a) an aquarium tank, said tank to be filled with water;

b) an assembly fitting on top of the tank;

c) a lighting system for the tank, said lighting system adjacent to the assembly fitting on top of the tank;

d) a plurality of artificial aquatic creatures, each of the plurality of creatures having a magnet encased in a body, each of the plurality of creatures having slightly negative buoyancy when submerged in water inside the aquarium tank;

e) at least one water pump within the tank, said at least one water pump producing a water flow which lifts and propels each of the plurality of creatures;

f) a plurality of electromagnets placed in various locations inside the tank, at least one of the plurality of electromagnets encased in a waterproof decorative casing; and g) a programmable logic controller located within the assembly on top of the tank, said programmable logic controller configured to control activation of the plurality of electromagnets, wherein the plurality of electromagnets generates a plurality of magnetic fields, said plurality of magnetic fields acting on the magnets contained within the creatures, said plurality of magnetic fields and the water flow causing the creatures to move within the tank.

41. The aquarium of claim 40 wherein at least one of the plurality of creatures is a fish.

42. The aquarium of claim 40 wherein the waterproof decorative casing is selected from the group consisting of:

a) an artificial coral b) an artificial rock; and c) an artificial plant.

43. The aquarium of claim 40 further including at least one input device configured to deliver an input signal to the programmable logic controller, said input device located within the tank.

44. The aquarium of claim 43 wherein the at least one input device is an optical sensor.

45. The aquarium of claim 43 wherein the at least one input device is attached to the waterproof decorative casing.

46. The aquarium of claim 40 wherein the at least one water pump has a graduated flow rate.

47. The aquarium of claim 40 further including a column placed inside the tank, said column contained inside a waterproof casing.

48. The aquarium of claim 47 wherein some of the plurality of electromagnets are located on the column.

49. The aquarium of claim 47 wherein at least one input device configured to deliver an input signal to the programmable logic controller is located on the column.

50. The aquarium of claim 40 wherein the tank has a half-cylindrical front face to promote laminar flow of water within the tank.

51. The artificial aquarium of claim 40 wherein a wall of the tank contains decoration selected from the group consisting of:

a) an artificial coral;

b) an artificial rock; and c) an artificial plant.

52. The artificial aquarium of claim 40 further including a backdrop attached to a back surface of the tank, said backdrop having decoration selected from the group consisting of:

a) an artificial coral;

b) an artificial rock; and c) an artificial plant.

53. The artificial aquarium of claim 52 further including a second lighting system to illuminate the backdrop.

54. The artificial aquarium of claim 52 wherein the backdrop is bowed.

55. A method of providing an artificial aquarium, said method comprising:

a) placing a plurality of artificial aquatic creatures in a tank, each of the plurality of artificial aquatic creatures having a magnet encased in a body;

b) operating at least one water pump within the tank, said at least water pump having a water flow which lifts and propels each of the plurality of creatures; and c) operating a plurality of electromagnets placed within the tank, said plurality of electromagnets creating a plurality of magnetic fields acting on the magnets within the creatures, wherein the magnetic fields and the water flow causes the creatures to move in a life-like manner within the tank.

56. The method of claim 55 wherein a programmable logic controller activates each of the plurality of electromagnets.

57. The method of claim 55 further including sending information to the programmable logic controller, said information sent by at least one input device.

58. The method of claim 57 wherein the information sent by at least one input device causes the programmable logic controller to turn on at least one electromagnet.

59. The method of claim 57 wherein the information sent by at least one input device causes the programmable logic controller to turn off at least one electromagnet.

60. The method of claim 55 wherein one of the plurality of electromagnets attracts one of the plurality of creatures.

61. The method of claim 55 wherein one of the plurality of electromagnets repels one of the plurality of creatures.

* * * * *

UNITED STATES PATENT AND TRADEMARK OFFICE

CERTIFICATE OF CORRECTION

PATENT NO. : 6,665,964 B2
APPLICATION NO. : 10/090225
DATED : December 23, 2003
INVENTOR(S) : Kimberly March Klotz It is certified that error appears in the above-identified patent and that said Letters Patent is hereby corrected as shown below:

Column 7, claim 18, line 16, "a) an artificial coral." should read:

-- a) an artificial coral;
b) an artificial rock; and
c) an artificial plant." --.

Column 7, claim 26, line 57, "...device is attached to of decorative casing." should read:

-- ... device is attached to the waterproof decorative casing. --.

Column 10, claim 58, line 25, "by at least one input device ..." should read:

"by the at least one input device ...".

Column 10, claim 59, line 30, "by at least one input device ..." should read:

-- by the at least one input device …--.

Signed and Sealed this

Thirtieth Day of November, 2010

David J. Kappos

David J. Kappos
*Director of the United States Patent and Trademark Office*